US008276767B2

(12) United States Patent
Su

(10) Patent No.: US 8,276,767 B2
(45) Date of Patent: Oct. 2, 2012

(54) SLIDING TYPE TOOL STORAGE STRUCTURE

(76) Inventor: Cheng-Wei Su, Taichung (TW)

( * ) Notice: Subject to any disclaimer, the term of this patent is extended or adjusted under 35 U.S.C. 154(b) by 34 days.

(21) Appl. No.: 13/046,575

(22) Filed: Mar. 11, 2011

(65) Prior Publication Data

US 2011/0226713 A1 Sep. 22, 2011

(30) Foreign Application Priority Data

Mar. 18, 2010 (TW) ..... 99107960 A

(51) Int. Cl.
*A47F 7/00* (2006.01)

(52) U.S. Cl. ..... 211/70.6; 206/376; 206/377

(58) Field of Classification Search ..... 211/4, 60.1, 211/65, 69, 69.1, 69.5, 70.2, 70.6, 70.8; 206/372, 206/373, 376, 377, 378; 248/316.7
See application file for complete search history.

(56) References Cited

U.S. PATENT DOCUMENTS 1,204,813 A * 11/1916 Murray ..... 211/8
1,221,584 A * 4/1917 Patrick ..... 211/8
2,588,110 A * 3/1952 Halliday ..... 211/4
3,635,433 A * 1/1972 Anderson ..... 211/70.8
4,027,798 A * 6/1977 Swaim ..... 211/4
6,749,074 B1 * 6/2004 Hileman et al. ..... 211/85.7
6,832,684 B2 * 12/2004 Huang ..... 206/376
6,837,382 B2 * 1/2005 Chen ..... 211/70.6
7,178,670 B2 * 2/2007 Chen ..... 206/376
7,219,464 B1 * 5/2007 Kujawa ..... 43/21.2
7,584,845 B2 * 9/2009 Cheng ..... 206/376
7,780,385 B2 * 8/2010 Brierton ..... 410/129
7,815,058 B2 * 10/2010 Cheng ..... 211/70.6
7,938,261 B1 * 5/2011 Lee ..... 206/376
8,047,386 B2 * 11/2011 Chen ..... 211/70.6
2007/0210021 A1 * 9/2007 Whitehead et al. ..... 211/70.6
2008/0156754 A1 * 7/2008 Cheng ..... 211/70.6
2009/0218302 A1 * 9/2009 Winnard ..... 211/70.6
2010/0065522 A1 * 3/2010 Cheng ..... 211/85.8
2010/0258515 A1 * 10/2010 Chen ..... 211/70.6

* cited by examiner

*Primary Examiner* — Darnell Jayne
*Assistant Examiner* — Joshua Rodden
(74) *Attorney, Agent, or Firm* — Alan Kamrath; Kamrath IP Lawfirm, PA

(57) ABSTRACT

A sliding type tool storage structure comprises an open-close switching unit clamped between a first storing element and a second storing element that can slide relative to each other. When the first storing element slides relative to the second storing element to change their relative position, stopping portions on the open-close switching unit will open or close tool storing grooves on the respective storing elements. Being a simple structure, the sliding type tool storage structure is easy to carry. Furthermore, since the tool storage structure can be operated simply by sliding of the first and second storing elements, it is very convenient to use.

11 Claims, 9 Drawing Sheets

SLIDING TYPE TOOL STORAGE STRUCTURE

BACKGROUND OF THE INVENTION

1. Field of the Invention

The present invention relates to a tool box, and more particularly to a sliding type tool storage structure.

2. Description of the Prior Art

Conventional tool boxes are mostly of flip type and comprise plural grooves therein for storage of tools. However, such a tool box has a large volume and is difficult to carry and inconvenient to use.

The present invention has arisen to mitigate and/or obviate the afore-described disadvantages.

SUMMARY OF THE INVENTION

The primary objective of the present invention is to provide a sliding type tool storage structure which has a simple structure and is easy to carry and convenient to use.

To achieve the above objective, a sliding type tool storage structure in accordance with the present invention comprises:

a first storing element including an outer surface, an inner surface, a first side and a second side opposite the first side, the first side and the second side being connected between the outer surface and the inner surface, the first storing element being formed with plural spaced tool storing grooves in the outer surface thereof, the first storing element being further formed in the inner surface thereof with a first control groove, the first control groove being formed with plural through-hole-shaped displacement spaces which are located adjacent to the respective tool storing grooves, respectively, the first storing element being further provided with a slidable positioning element on the inner surface thereof;

an open-close switching unit including plural first stopping portions on a first surface thereof and plural second stopping portions on a second surface opposite the first surface thereof, the first stopping portions and the second stopping portions extending in opposite directions, each of the first and the second stopping portions including a stopping end, the respective first stopping portions being inserted into the displacement spaces of the first control groove; and a second storing element including an outer surface, an inner surface, a first side and a second side opposite the first side thereof, the second storing element being formed with plural tool storing grooves in the outer surface thereof and formed with a slide corresponding element on the inner surface thereof, the slidable positioning element of the first storing element being slidably assembled to the slide corresponding element of the second storing element, the open-close switching unit being clamped between the first storing element and the second storing element, the first side and the second side of the first storing element being arranged opposite the first side and the second side of the second storing element, respectively, the second storing element being formed in the inner surface thereof with a second control groove, the second control groove being formed with plural through-hole-shaped displacement spaces which are located adjacent to the respective tool storing grooves of the second storing element, the respective second stopping portions of the open-close switching unit being inserted into the respective displacement spaces of the second control groove, between a first side of the open-close switching unit and a second groove surface of the first control groove adjacent to the second side of the first storing element being defined a first control clearance, between a second side of the open-close switching unit and a first groove surface of the first control groove adjacent to the first side of the second storing element being defined a second control clearance.

The first storing element is allowed to slide in a direction of the first side thereof through the first control clearance, and the second storing element is allowed to slide in a direction of the second side thereof through the second control clearance. The sliding of the first storing element and the second storing element changes a relative position of the respective tool storing grooves with respect to the respective stopping ends, thus opening or closing the respective tool storing grooves. As known from the above-mentioned, the sliding type tool storage structure in accordance with the present invention has a simple structure, so it is easy to carry. Furthermore, the tool storage structure in accordance with the present invention can be opened or closed by sliding of two elements, so it is very convenient to use.

DETAILED DESCRIPTION OF THE PREFERRED EMBODIMENTS

Figure 1:
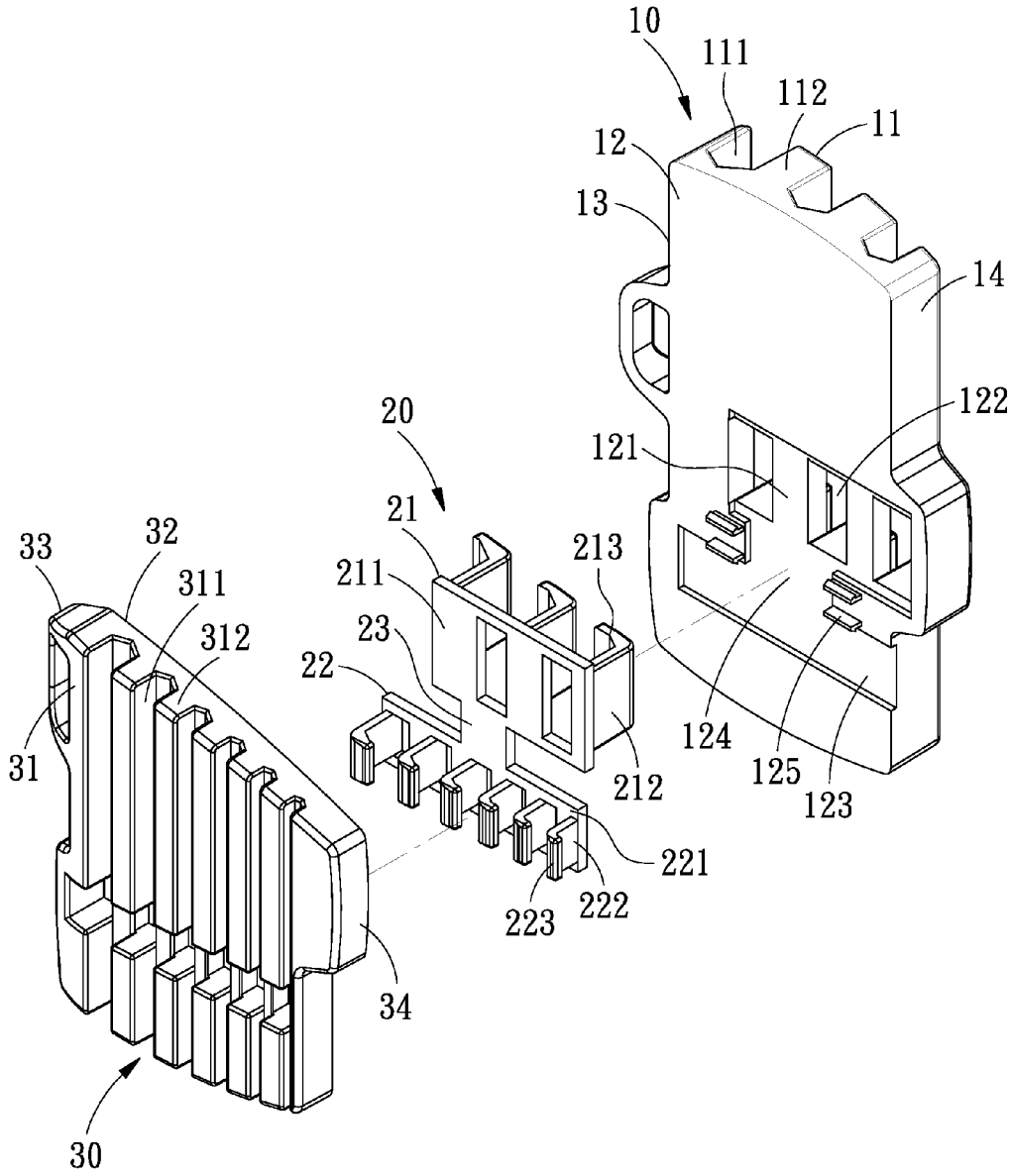
FIG. 1 is an exploded view of a sliding type tool storage structure in accordance with the present invention.
Figure 2:
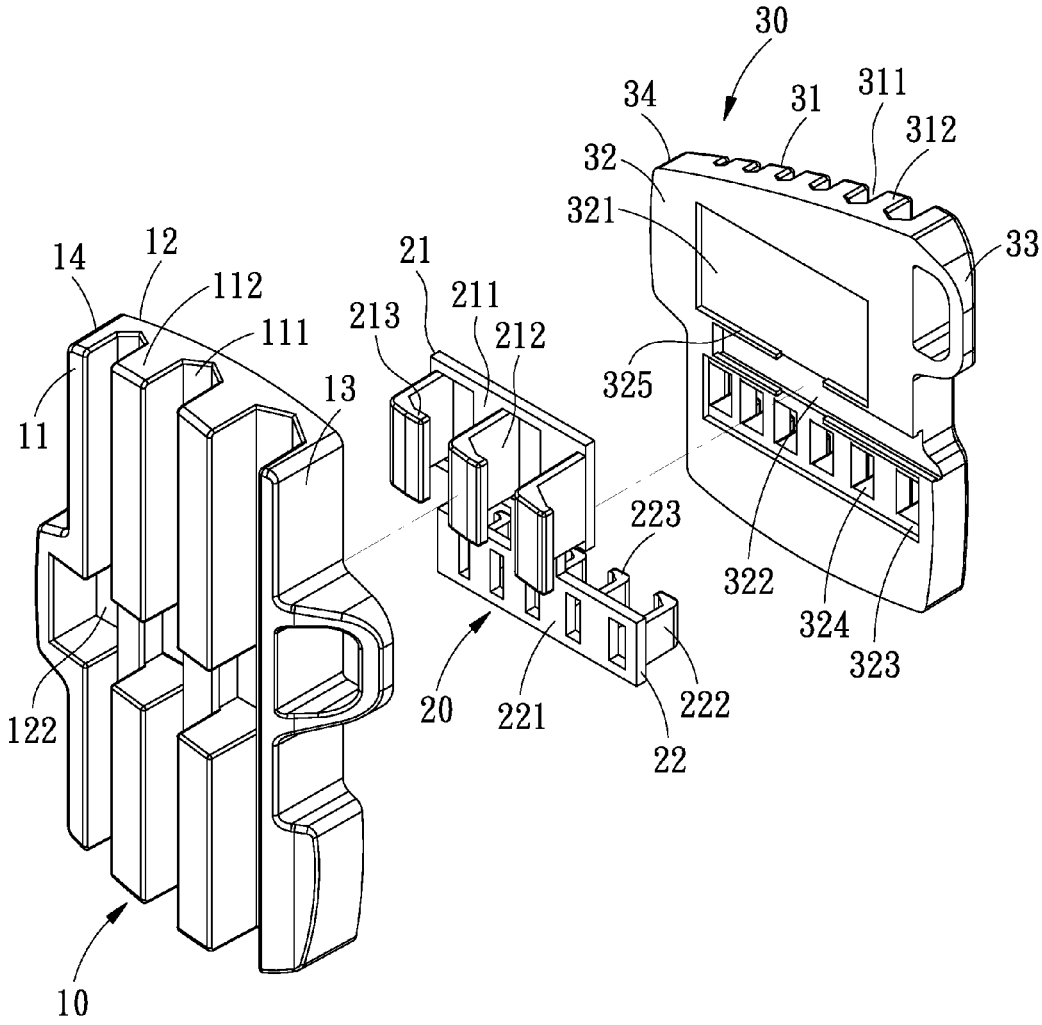
FIG. 2 is another exploded view of the sliding type tool storage structure in accordance with the present invention.

Referring to FIGS. 1-7, a sliding type tool storage structure in accordance with a preferred embodiment of the present invention is adapted for storing tool heads and comprises a first storing element 10, an open-close switching unit 20, and a second storing element 30.

The first storing element 10 includes an outer surface 11, an inner surface 12, a first side 13 and a second side 14 opposite the first side 13. The first side 13 and the second side 14 are connected between the outer surface 11 and the inner surface 12. The first storing element 10 is formed with plural spaced tool storing grooves 111 in the outer surface 11. In the present embodiment, the first storing element 10 is formed with three polygon tool storing grooves 111 for storing hexagonal column-shaped hand tools. Of course, the tool storing grooves 111 can also be configured in other forms for storing other forms of hand tools. The respective tool storing grooves 111 of the first storing element 10 are formed with an abdominal portion 112 in a direction of the second side 14. The first storing element 10 is further formed in the inner surface 12 with a first control groove 121. The first control groove 121 is formed with plural through-hole-shaped displacement spaces 122 penetrating the respective abdominal portions 112. The first storing element 10 is further formed in the inner surface 12 with a second control groove 123. Between the first control groove 121 and the second control groove 123 is connected a connecting groove 124. The first storing element 10 is provided on the inner surface 12 with a slidable positioning element 125 at each of two opposite sides of the connecting groove 124. The slidable positioning element 125 in the present embodiment is a clamping hook.

The open-close switching unit 20 includes a first control portion 21, a second control portion 22 and a connecting portion 23 connected between the first control portion 21 and the second control portion 22. The first control portion 21 includes a first panel 211 formed correspondingly to the first control groove 121 of the first storing element 10. The first panel 211 is further formed with plural first stopping portions 212 extending therefrom. The first stopping portions 212 in the present embodiment are L-shaped. The number of the first stopping portions 212 is the same as that of the displacement spaces 122 of the first storing element 10. Each of the first stopping portions 212 includes a stopping end 213. The second control portion 22 includes a second panel 221 formed correspondingly to the second control groove 123 of the first storing element 10. The second panel 221 is formed with plural second stopping portions 222 extending therefrom. The second stopping portions 222 in the present embodiment are L-shaped. The first stopping portions 212 and the second stopping portions 222 extend in opposite directions. The first panel 211 of the first control portion 21 of the open-close switching unit 20 is disposed in the first control groove 121 of the first storing element 10, and the first stopping portions 212 of the first control portion 21 are inserted into the respective displacement spaces 122 of the first control groove 121. The stopping ends 213 of the first stopping portions 212 of the first control portion 21 are stopped outside the respective tool storing grooves 111. The connecting portion 23 is disposed in the connecting groove 124 of the first storing element 10, and the second control portion 22 is disposed in the second control groove 123 of the first storing element 10.

The second storing element 30 includes an outer surface 31, an inner surface 32, a first side 33 and a second side 34 opposite the first side 33. The first side 33 and the second side 34 are connected between the outer surface 31 and the inner surface 32. The second storing element 30 is formed with plural polygon tool storing grooves 311 in the outer surface 31. The respective tool storing grooves 311 of the second storing element 30 are formed with an abdominal portion 312 in a direction of the first side 33. The second storing element 30 is further formed in the inner surface 32 with a first control groove 321, a sliding groove 322 and a second control groove 323. The first control grooves 121, 321 of the first storing element 10 and the second storing element 30 are arranged opposite each other, the connecting groove 124 of the first storing element 10 is arranged opposite the sliding groove 322 of the second storing element 30, and the second control grooves 123, 323 of the second are arranged opposite each other. The open-close switching unit 20 is clamped between the first storing element 10 and the second storing element 30. The first panel 211 of the first control portion 21 of the open-close switching unit 20 is disposed between the first control groove 121 of the first storing element 10 and the first control groove 321 of the second storing element 30. The connecting portion 23 is disposed between the connecting groove 124 of the first storing element 10 and the sliding groove 322 of the second storing element 30. The second control portion 22 is disposed between the second control groove 123 of the first storing element 10 and the second control groove 323 of the second storing element 30. The second control groove 323 of the second storing element 30 is further formed with plural displacement spaces 324. The number of the displacement spaces 324 of the second storing element 30 is the same as that of the second stopping portions 222 of the second panel 221 of the open-close switching unit 20. By such an arrangement, the inner surfaces 12, 32 of the first storing element 10 and the second storing element 30 are arranged opposite each other, and the first side 13 of the first storing element 10 is arranged opposite the first side 33 of the second storing element 30, and the second side 14 of the first storing element 10 is arranged opposite the second side 34 of the second storing element 30. The first stopping portions 212 of the first panel 211 of the open-close switching unit 20 are inserted into the respective displacement spaces 122 of the first storing element 10, and the stopping ends 213 of the first stopping portions 212 of the first panel 211 are stopped outside the respective tool storing grooves 111 of the first storing element 10. Furthermore, the first panel 211 is disposed between the first control groove 121 of the first storing element 10 and the first control groove 321 of the second storing element 30 while the second panel 221 is disposed between the second control groove 123 of the first storing element 10 and the second control groove 323 of the second storing element 30. The second stopping portions 222 of the second panel 221 are inserted into the respective displacement spaces 324 of the second storing element 30, and the stopping ends 213 of the respective second stopping portions 222 on the second panel 221 are stopped outside the respective displacement spaces 324 of the second storing element 30. The second storing element 30 is formed with slide corresponding elements 325 on an edge of the sliding groove 322 correspondingly to the slidable positioning elements 125 in such a manner that the slidable positioning elements 125 of the first storing element 10 can be slidably hooked at the slide corresponding elements 325 of the second storing element 30 to make the first storing element 10 be slidably positioned on the second storing element 30. When the respective stopping portions 212, 222 of the open-close switching unit 20 are disposed in the corresponding displacement spaces 122, 324 of the first storing element 10 and the second storing element 30, and the slidable positioning elements 125 of the first storing element 10 are slidably disposed on the slide corresponding elements 325 of the second storing element 30, the assembly of the present invention is finished.

After the assembly of the first storing element 10, the open-close switching unit 20 and the second storing element 30, the first panel 211 of the first control portion 21 of the open-close switching unit 20 will be clamped by a first groove surface of the first control groove 121 adjacent to the first side 13 of the first storing element 10 and a second groove surface of the first control groove 321 adjacent to the second side 34 of the second storing element 30. Between the first panel 211 and a second groove surface of the first control groove 121 adjacent to the second side 14 of the first storing element 10 is defined a first control clearance D1, and between the first panel 211 and a first groove surface of the first control groove 321 adjacent to the first side 33 of the second storing element 30 is defined a second control clearance D2. The second panel 221 of the second control portion 22 of the open-close switching unit 20 is clamped by a first groove surface of the second control groove 123 adjacent to the first side 13 of the first storing element 10 and a second groove surface of the second control groove 323 adjacent to the second side 34 of the second storing element 30. Between the second panel 221 and a second groove surface of the second control groove 123 adjacent to the second side 14 of the first storing element 10 is defined a third control clearance D3, and between the second panel 221 and a first groove surface of the second control groove 323 adjacent to the first side 33 of the second storing element 30 is defined a fourth control clearance D4.

Figure 3:
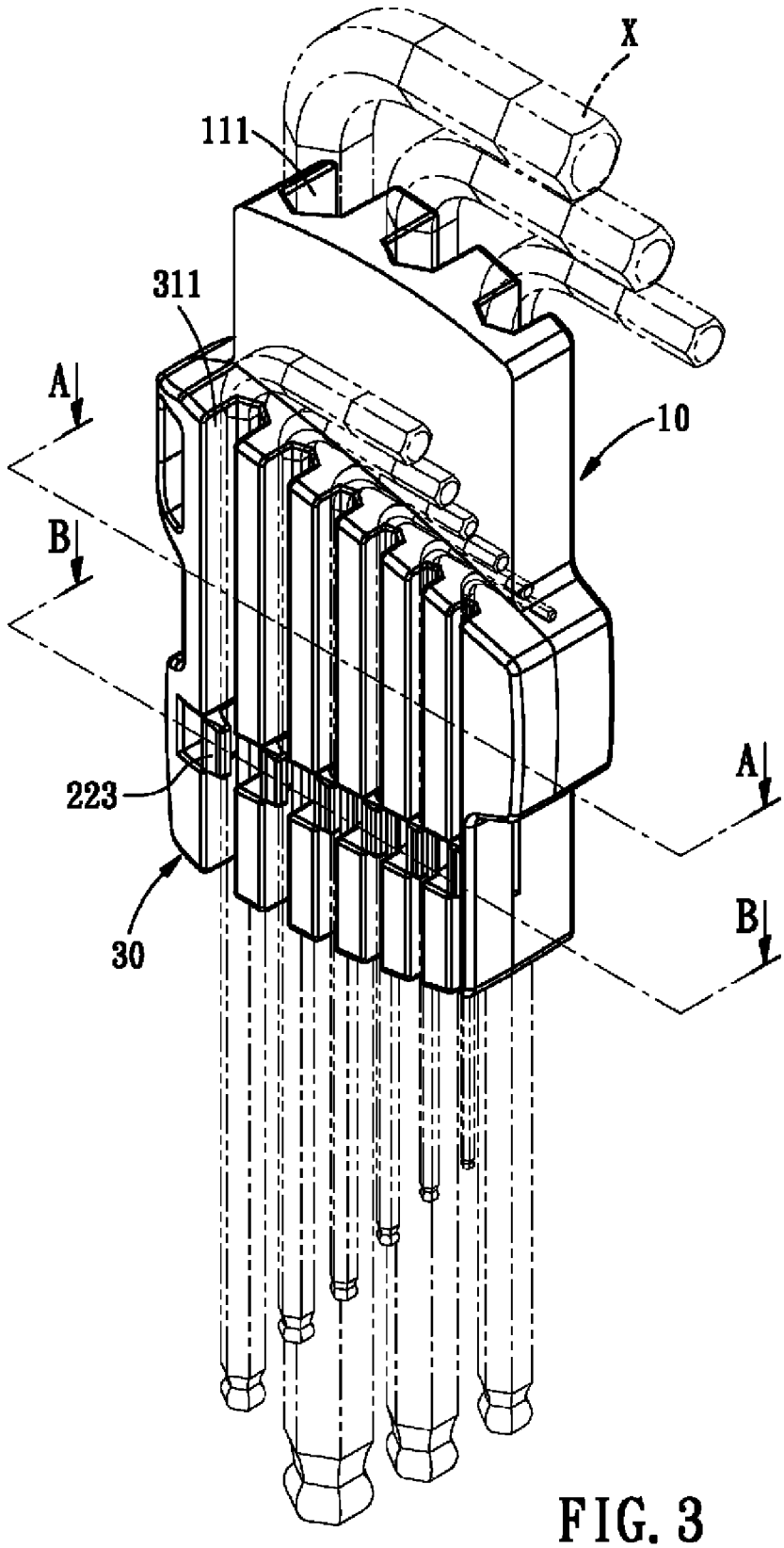
FIG. 3 is a perspective view of the sliding type tool storage structure in accordance with the present invention.
Figure 4:
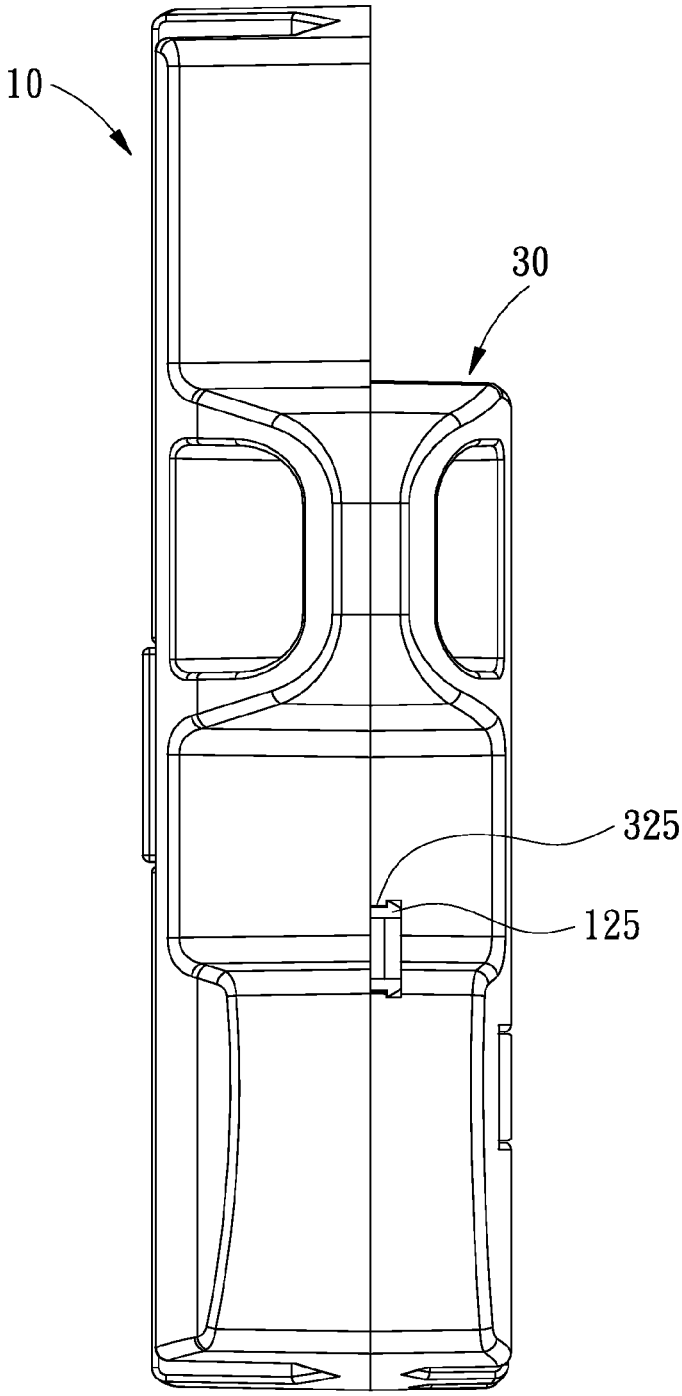
FIG. 4 is a side assembly view of the sliding type tool storage structure in accordance with the present invention.
Figure 5:
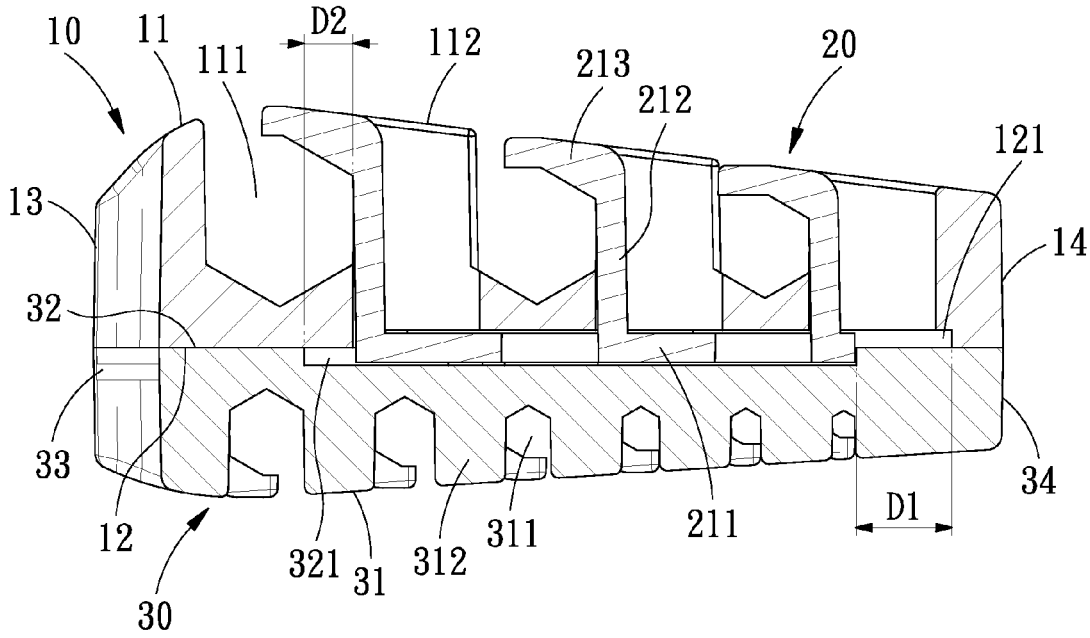
FIG. 5 is a cross-sectional view of the sliding type tool storage structure in accordance with the present invention along the line A-A of FIG. 3.
Figure 6:
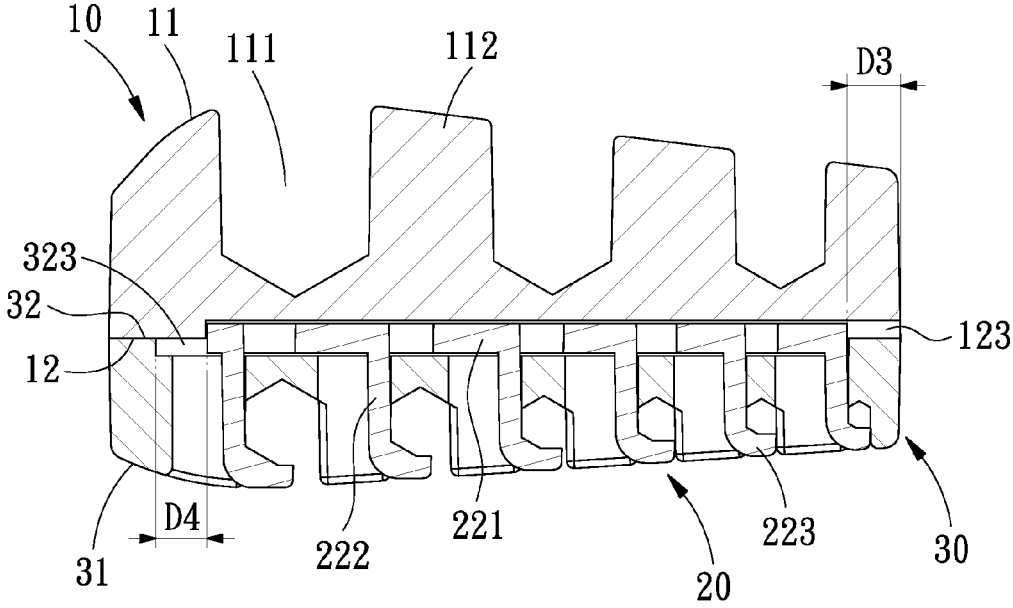
FIG. 6 is a cross-sectional view of the sliding type tool storage structure in accordance with the present invention along the line B-B of FIG. 3.
Figure 7:
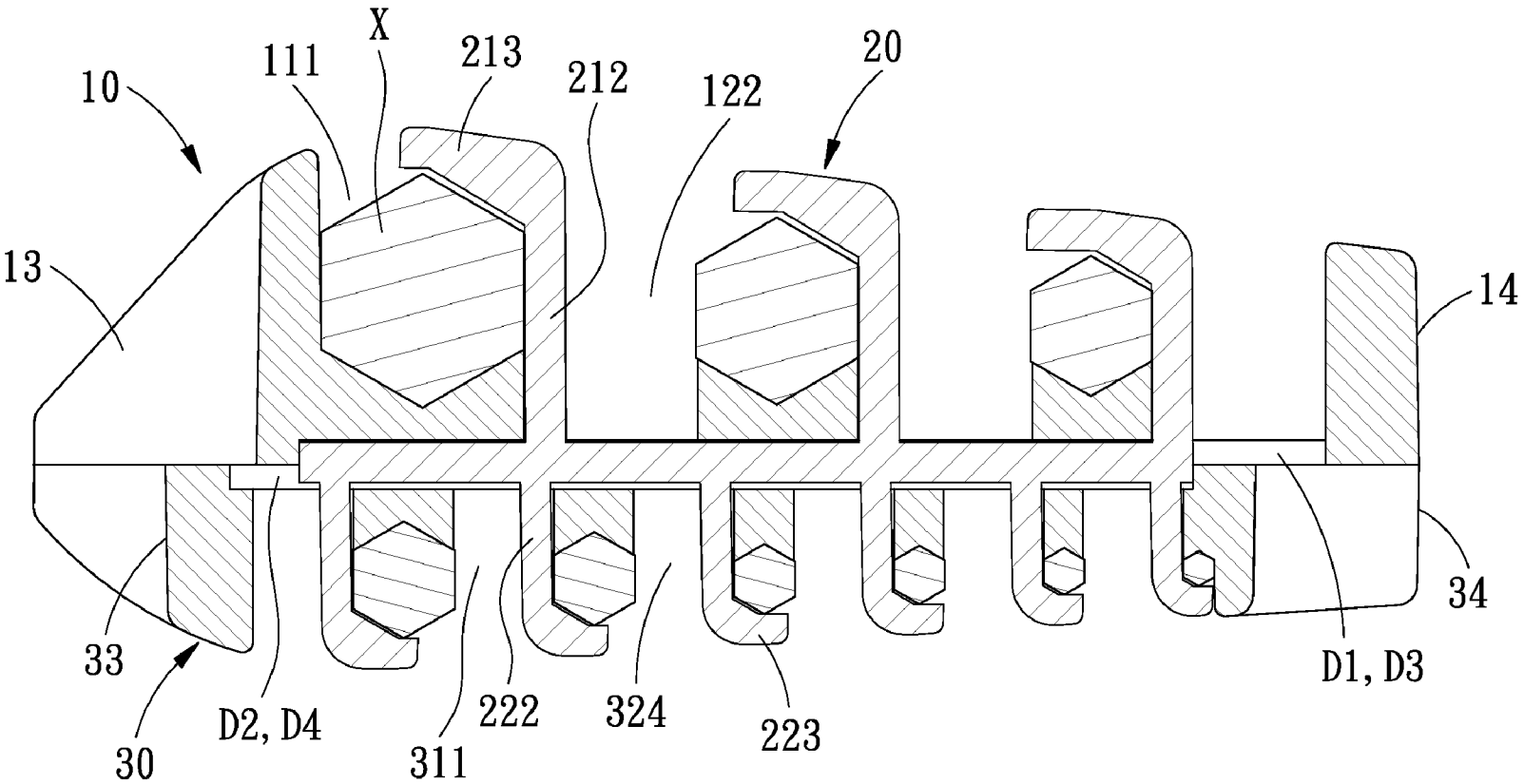
FIG. 7 is a cross-sectional view showing that tool heads are stored in the closed sliding type tool storage structure in accordance with the present invention.
Figure 8:
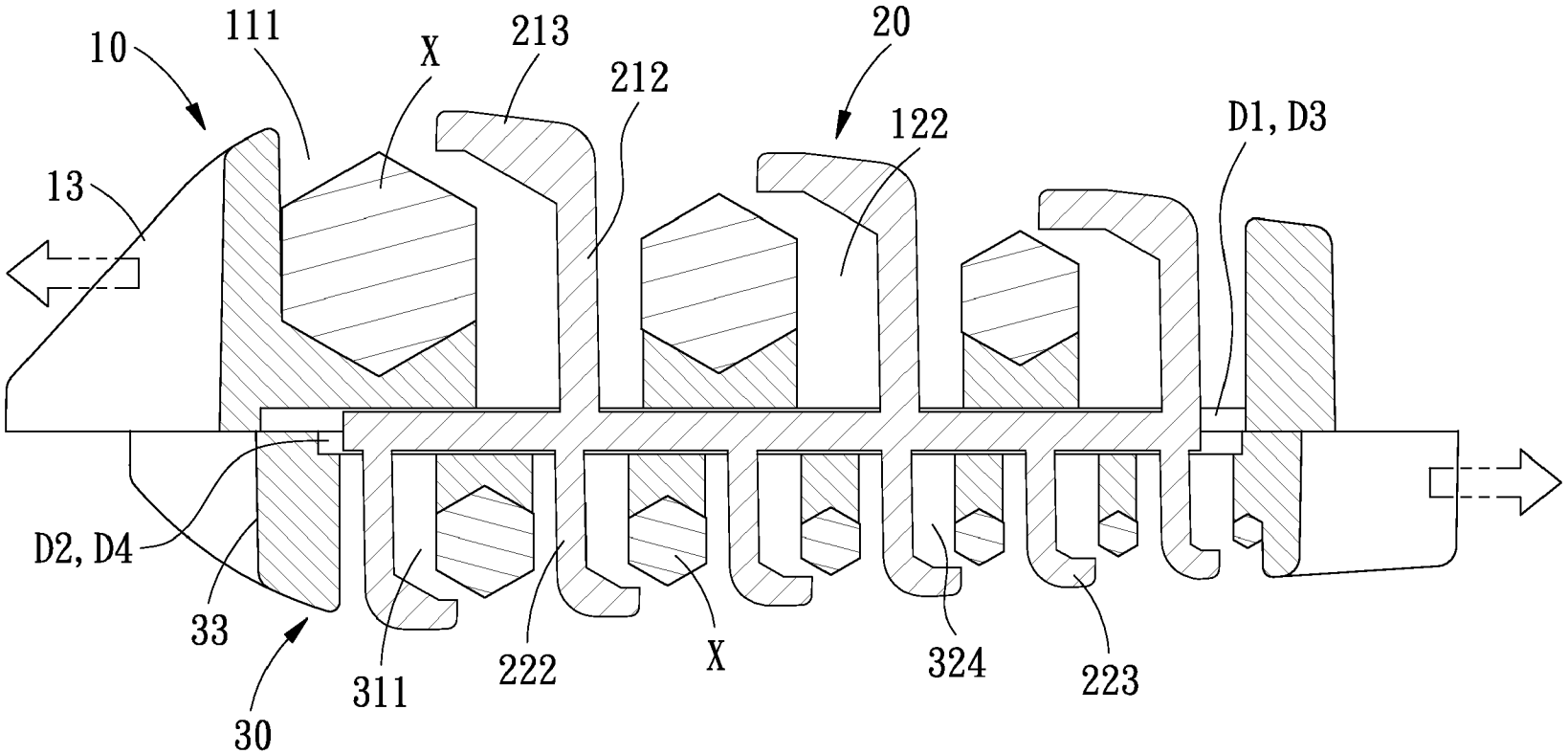
FIG. 8 is a cross-sectional view showing how the first storing element slides relative to the second storing element.
Figure 9:
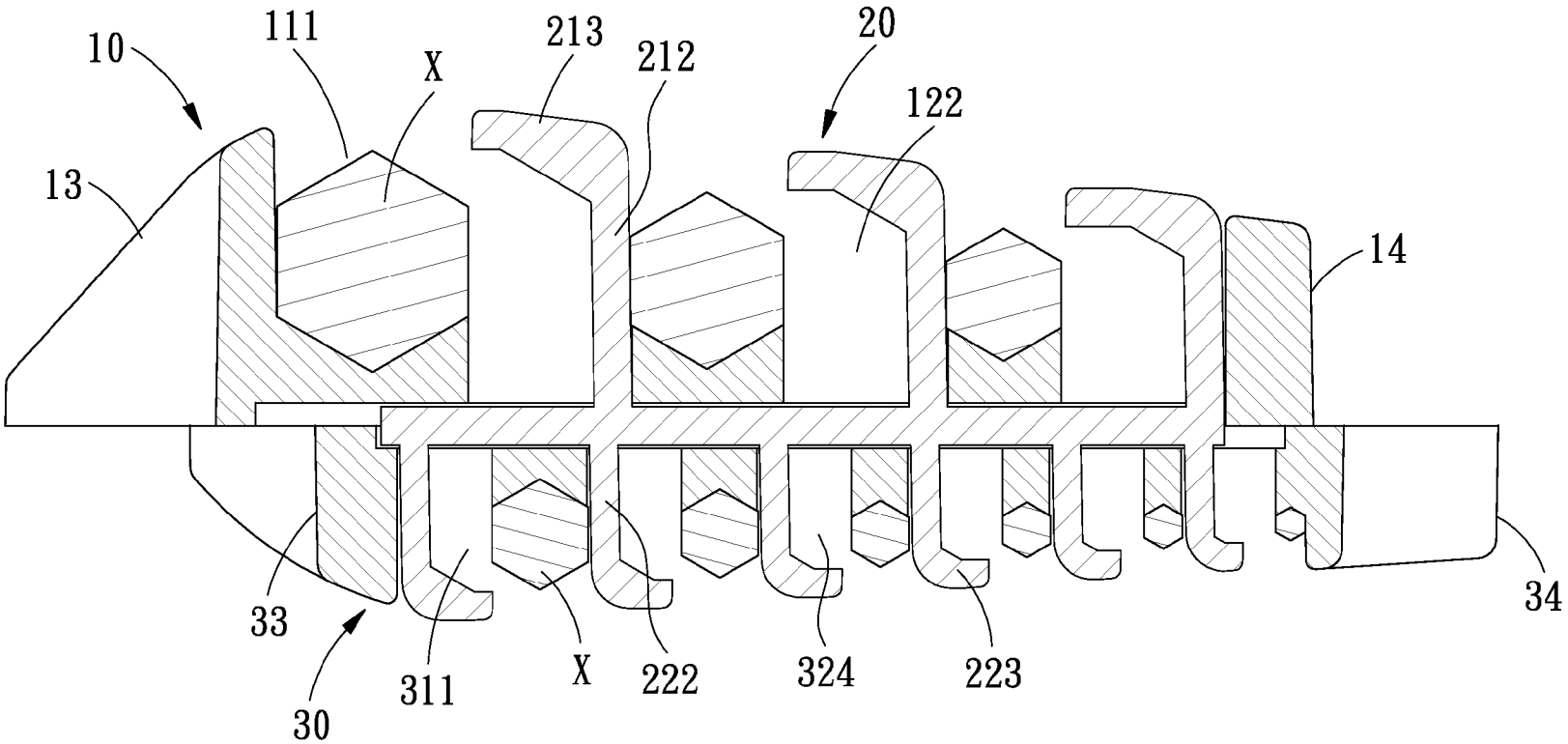
FIG. 9 is a cross-sectional view showing that the tool storing grooves of the sliding type tool storage structure in accordance with the present invention are completely opened.

As known from the above-mentioned, after the assembly of the first storing element 10, the open-close switching unit 20 and the second storing element 30, the tool storing grooves 111, 311 of the first storing element 10 and the second storing element 30 are used to store tool heads X, as shown in FIG. 3. The first storing element 10 and the second storing element 30 are slidably positioned, and the open-close switching unit 20 is clamped by the first storing element 10 and the second storing element 30. However, since between the first control portion 21, the second control portion 22 of the open-close switching unit 20 and the second sides 14, 34 of the first storing element 10 and the second storing element 30 are defined the first control clearance D1 and the third control clearance D3, and between the first control portion 21, the second control portion 22 of the open-close switching unit 20 and the first sides 13, 33 of the first storing element 10 and the second storing element 30 are defined the second control clearance D2 and the fourth control clearance D4, as shown in FIGS. 5 and 6. Therefore, it shall be known that the first control clearance D1 and the third control clearance D3 between the first storing element 10, the second storing element 30 and the open-close switching unit 20 are both adjacent to the second sides 14, 34, and the second control clearance D2 and the fourth control clearance D4 are both adjacent to the first sides 13, 33, so that the first storing element 10 and the second storing element 30 are allowed to slide relative to each other. The first storing element 10 is allowed to slide toward the first sides 13, 33 through the first and the third clearances D1, D3 adjacent to the second sides 14, 34, and the second storing element 30 is allowed to slide toward the second sides 14, 34 through the second and the fourth clearances D2, D4 adjacent to the first sides 13, 33. For a better understanding of the relative movement of these elements, reference should be made to FIGS. 7-9. The control clearances D1, D2, D3, D4 of the first storing element 10 and the second storing element 30 with respect to the open-close switching unit 20 are simplified on the same plane for facilitating description. As shown in FIGS. 7-9, due to the first and the third control clearances D1, D3 between the open-close switching unit 20 and the first storing element 10 adjacent to the second sides 14, 34, the first storing element 10 can be moved toward the first sides 13, 33. Due to the second and the fourth control clearances D2, D4 between the open-close switching unit 20 and the second storing element 30 adjacent to the first sides 13, 33, the second storing element 30 can be moved toward the second sides 14, 34. When the first storing element 10 is moved toward the first sides 13, 33, and the second storing element 30 will move toward the second sides 14, 34, without movement of the open-close switching unit 20, the stopping ends 213, 223 which were originally stopped outside the tool storing grooves 111, 311 will retract into the displacement spaces 122, 324 due to the movement of the first and the second storing elements 10, 30 and make the tool storing grooves 111, 311 in a complete open state for facilitating storing the tool heads X. However, when the stopping ends 213, 223 are stopped outside the tool storing grooves 111, 311, the tool storing grooves 111, 311 will be in a closed state for preventing the disengagement of the tool heads X. To summarize, the tool storing grooves 111, 311 can be opened or closed by making the first storing element 10 and the second storing element 30 slide relative to each other, so that it can be found that the sliding type tool storage structure of the present invention is convenient to operate and has a simple structure and a relatively small volume. As a result, the sliding type storage structure of the present invention is easy to carry.

Figure 10:
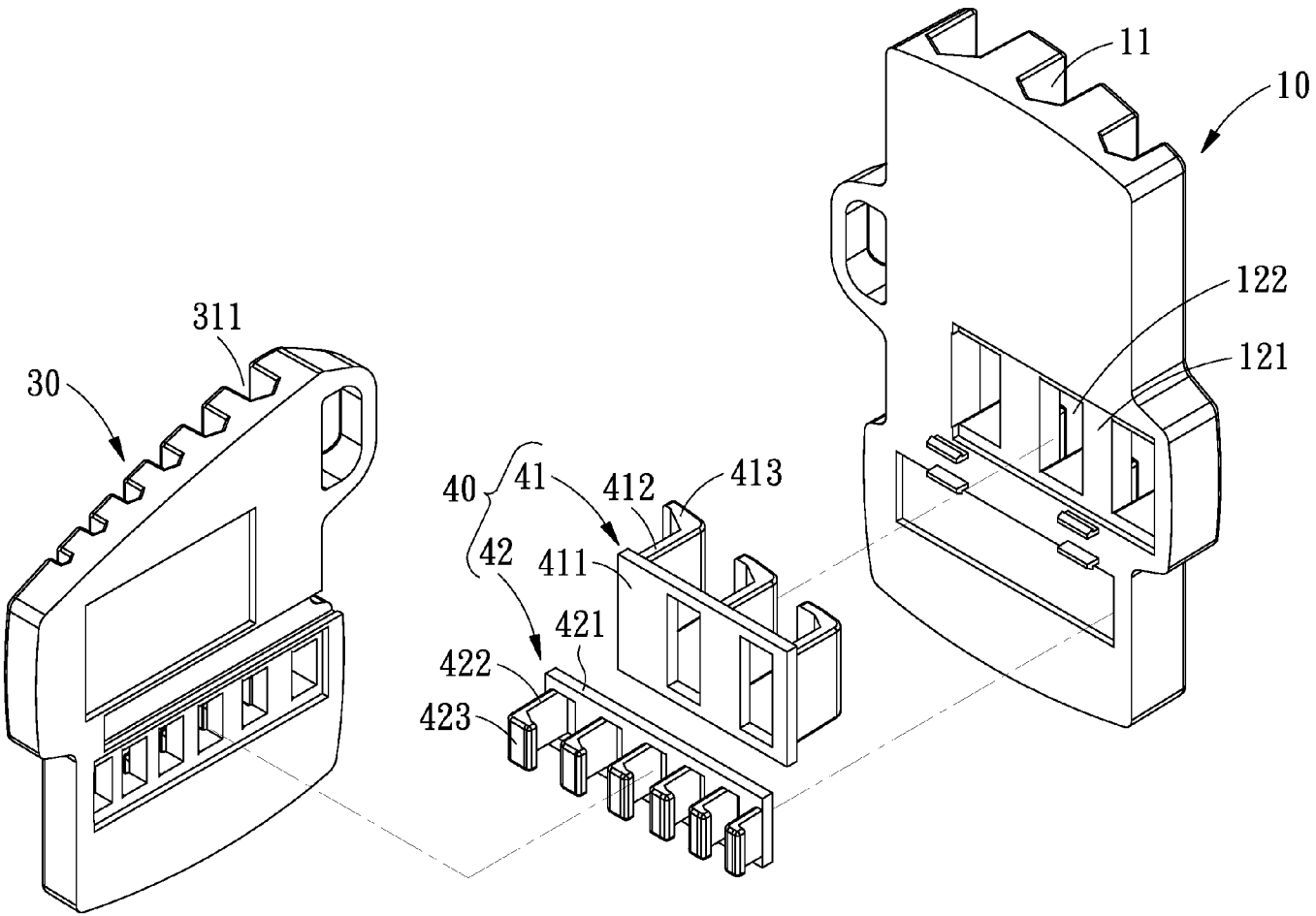
FIG. 10 is an exploded view of another sliding type tool storage structure in accordance with the present invention.

Referring to FIG. 10 showing a sliding type tool storage structure in accordance with a second embodiment of the present invention, an open-close switching unit 40 in accordance with the second embodiment of the present invention includes a first control element 41 and a second control element 42 that are two separate parts. The first storing element 10 is not formed with the connecting groove 124. The first control element 41 is clamped by the first control grooves 121, 321 of the first storing element 10 and the second storing element 30. The second control element 42 is clamped by the second control grooves 123, 323 of the first storing element 10 and the second storing element 30. The first control element 41 also includes a first panel 411 which is formed with plural first stopping portions 412, and each of the first stopping portions 412 includes a stopping end 413. The second control element 42 also includes a second panel 421 which is formed with plural second stopping portions 422, and each of the second stopping portions 422 includes a stopping end 423. In the same way, the stopping ends 413, 423 of the first control element 41 and the second control element 42 can also be used to open and close the tool storing grooves 111, 311 of the first storing element 10 and the second storing element 30.

While we have shown and described various embodiments in accordance with the present invention, it is clear to those skilled in the art that further embodiments may be made without departing from the scope of the present invention.

What is claimed is:

1. A sliding type tool storage structure being adapted for storing tool heads, comprising:

a first storing element including an outer surface, an inner surface, a first side and a second side opposite the first side, the first side and the second side being connected between the outer surface and the inner surface, the first storing element being formed with plural spaced tool storing grooves in the outer surface thereof, the first storing element being further formed in the inner surface thereof with a first control groove, the first control groove being formed with plural through-hole displacement spaces which are located adjacent to the respective tool storing grooves, respectively, the first storing element being further provided with at least one slidable positioning element on the inner surface thereof;

an open-close switching unit including plural first stopping portions on a first surface thereof and plural second stopping portions on a second surface opposite the first surface thereof, the first stopping portions and the second stopping portions extending in opposite directions, each of the first and the second stopping portions including a stopping end, each first stopping portion being inserted into a respective one of the displacement spaces of the first control groove; and a second storing element including an outer surface, an inner surface, a first side and a second side opposite the first side thereof, the second storing element being formed with plural tool storing grooves in the outer surface thereof and formed with at least one slide corresponding element on the inner surface thereof, the slidable positioning element of the first storing element being slidably connected to the slide corresponding element of the second storing element, the open-close switching unit being clamped between the first storing element and the second storing element, the first side and the second side of the first storing element being arranged adjacent the first side and the second side of the second storing element, respectively, the second storing element being formed in the inner surface thereof with a second control groove, the second control groove being formed with plural through-hole displacement spaces which are located adjacent to the respective tool storing grooves of the second storing element, the respective second stopping portions of the open-close switching unit each being inserted into a respective one of the respective displacement spaces of the second control groove, between a first side of the open-close switching unit and a second groove surface of the first control groove of the first control element adjacent to the second side of the first storing element being defined a first control clearance, between a second side of the open-close switching unit and a first groove surface of the first control groove of the second control element adjacent to the first side of the second storing element being defined a second control clearance, the first storing element being allowed to slide in a direction of the first side of the first storing element thereof through the first control clearance, the second storing element being allowed to slide in a direction of the second side of the second storing element thereof through the second control clearance, the sliding of the first storing element and the second storing element changing a relative position of the respective tool storing grooves of the first and second storing elements with respect to the respective stopping ends of the first and second storing elements so as to open/close the respective tool storing grooves of the first and second storing elements.

2. The sliding type tool storage structure as claimed in claim 1, wherein the tool storing grooves of the first storing element and the second storing element are polygon shaped grooves.

3. The sliding type tool storage structure as claimed in claim 1, wherein the respective tool storing grooves of the first storing element are formed adjacent abdominal portions, the respective displacement spaces of the first storing element each penetrate a respective one of the respective abdominal portions of the first storing element, the respective tool storing grooves of the second storing element are formed adjacent abdominal portions, the respective displacement spaces of the second storing element each penetrate a respective one of the respective abdominal portions of the second storing element.

4. The sliding type tool storage structure as claimed in claim 1, wherein the first storing element is formed in the inner surface thereof with a second control groove, between the first control groove and the second control groove of the first storing element is a connecting groove, at each of two opposite sides of the connecting groove is provided one of said slidable positioning element, the second storing element further includes a first control groove and a sliding groove on the inner surface thereof, the second storing element is formed on an edge of the sliding groove with a corresponding number of the slide corresponding elements to be slidably assembled to the respective slidable positioning elements, the sliding groove of the second storing element is connected between the first control groove and the second control groove of the second storing element, the first control grooves of the first storing element and the second storing element are arranged opposite each other, the connecting groove of the first storing element is arranged opposite the sliding groove of the second storing element, the second control grooves of the first storing element and the second storing element are arranged opposite each other.

5. The sliding type tool storage structure as claimed in claim 1, wherein the at least one slidable positioning element is a clamping hook.

6. The sliding type tool storage structure as claimed in claim 4, wherein the open-close switching unit includes a first control portion, a second control portion and a connecting portion connected between the first control portion and the second control portion, the first control portion includes a first panel formed correspondingly to the first control groove of the first storing element, the first panel is further formed with the first stopping portions extending therefrom, the second control portion includes a second panel formed correspondingly to the second control groove of the first storing element, the second panel is further formed with the second stopping portions extending therefrom, the first panel of the first control portion of the open-close switching unit is disposed between the first control groove of the first storing element and the first control groove of the second storing element, the connecting portion is disposed between the connecting groove of the first storing element and the sliding groove of the second storing element, and the second control portion is disposed between the second control groove of the first storing element and the second control groove of the second storing element.

7. The sliding type tool storage structure as claimed in claim 1, wherein the respective first and second stopping portions are L-shaped, the number of the first stopping portions and the second stopping portions of the open-close switching unit is the same as that of the displacement spaces of the first storing element and the second storing element, respectively.

8. The sliding type tool storage structure as claimed in claim 6, wherein when the respective first stopping portions of the first panel of the open-close switching unit are inserted into the respective displacement spaces of the first storing element, the stopping ends of the first stopping portions of the first panel are stopped outside the respective tool storing grooves of the first storing element, the first panel is disposed in the first control groove of the second storing element, and the second panel is disposed in the second control groove of the first storing element, and when the second stopping portions of the second panel are inserted into the respective displacement spaces of the second storing element, the stopping ends of the respective second stopping portions on the second panel are stopped outside the respective displacement spaces of the second storing element.

9. The sliding type tool storage structure as claimed in claim 8, wherein the first panel of the first control portion of the open-close switching unit is clamped by a first groove surface of the first control groove of the first storing element adjacent to the first side of the first storing element and a second groove surface of the first control groove of the second storing element adjacent to the second side of the second storing element, the second panel of the second control portion of the open-close switching unit is clamped by a first groove surface of the second control groove of the first storing element adjacent to the first side of the first storing element and a second groove surface of the second control groove of the second storing element adjacent to the second side of the second storing element.

10. The sliding type tool storage structure as claimed in claim 9, wherein the first control clearance is defined between the first panel and the second groove surface of the first control groove of the first storing element adjacent to the second side of the first storing element, the second control clearance is defined between the first panel and the first groove surface of the first control groove of the second storing element adjacent to the first side of the second storing element, between the second panel and a second groove surface of the second control groove of the first storing element adjacent to the second side of the first storing element is defined a third control clearance, and between the second panel and a first groove surface of the second control groove of the second storing element adjacent to the first side of the second storing element is defined a fourth control clearance.

11. A sliding type tool storage structure comprising:

a first storing element including an outer surface, an inner surface, a first side and a second side opposite the first side, the first storing element being formed with plural spaced tool storing grooves in the outer surface thereof, the first storing element being further formed in the inner surface thereof with a first control groove, the first control groove being formed with plural through-hole displacement spaces, the respective displacement spaces being located adjacent to the respective tool storing grooves, respectively, the first storing element being further provided with a slidable positioning element on the inner surface thereof;

a first control element including a first panel being formed with plural first stopping portions, and each of the first stopping portions including a stopping end, the first panel of the first control element being disposed in the first control groove of the first storing element, each first stopping portions being inserted into a respective one of the displacement spaces of the first storing element through the inner surface of the first storing element;

a second control element including a second panel which is formed with plural second stopping portions, and each of the second stopping portions including a stopping end; and a second storing element including an outer surface, an inner surface, a first side and a second side opposite the first side thereof, the second storing element being formed with plural tool storing grooves in the outer surface thereof and provided with a slide corresponding element on the inner surface thereof, the slidable positioning element of the first storing element being slidably connected to the slide corresponding element of the second storing element, the first control element and the second control element being clamped between the first storing element and the second storing element, the first side and the second side of the first storing element being arranged adjacent to the first side and the second side of the second storing element, respectively, the second storing element being formed in the inner surface thereof with a second control groove, the second control groove being formed with plural through-hole displacement spaces which are located adjacent to the respective tool storing grooves of the second storing element, each respective second stopping portion of the second control element being inserted into a respective one of the respective displacement spaces of the second control groove of the second storing element, between a side of the first control element and a second groove surface of the first control groove of the first storing element adjacent to the second side of the first storing element being defined a first control clearance, between a side of the second control element and a first groove surface of the second control groove adjacent to the first side of the second storing element being defined a second control clearance, the first storing element being allowed to slide in a direction of the first side of the first control element thereof through the first control clearance, the second storing element being allowed to slide in a direction of the second side of the second control element thereof through the second control clearance, the sliding of the first storing element and the second storing element changing a relative position of the respective tool storing grooves of the first and second control elements with respect to the respective stopping ends of the first and the second control element so as to open/close the respective tool storing grooves of the first and second storing elements.

* * * * *